US008056445B2

(12) United States Patent
Jackson, III

(10) Patent No.: US 8,056,445 B2
(45) Date of Patent: Nov. 15, 2011

(54) MULTI-TASK-TOOL

(76) Inventor: Denton L. Jackson, III, Coldwater, MS (US)

( * ) Notice: Subject to any disclaimer, the term of this patent is extended or adjusted under 35 U.S.C. 154(b) by 337 days.

(21) Appl. No.: 12/316,082

(22) Filed: Dec. 9, 2008

(65) Prior Publication Data

US 2010/0139459 A1 Jun. 10, 2010

(51) Int. Cl.
*B25B 23/16* (2006.01)

(52) U.S. Cl. ..... 81/53.1; 81/487

(58) Field of Classification Search ..... 81/53.1, 81/3.8, 487, 901; 294/19.1, 24
See application file for complete search history.

(56) References Cited

U.S. PATENT DOCUMENTS 1,244,339 A * 10/1917 Johnson, Jr. ..... 439/477
1,744,356 A * 1/1930 Bodendieck ..... 81/53.1
1,920,168 A * 8/1933 Bodendieck ..... 81/53.1
2,016,749 A * 10/1935 Mack ..... 81/53.1
2,099,921 A * 11/1937 Becker ..... 81/53.1
2,194,411 A * 3/1940 Tipsord ..... 81/53.1
2,316,204 A * 4/1943 Williams ..... 81/53.1
2,352,686 A * 7/1944 Broadbooks ..... 81/53.1
3,111,049 A * 11/1963 Brehmer ..... 81/57.26
4,132,441 A * 1/1979 Watkins ..... 294/19.1
4,470,328 A * 9/1984 Landis ..... 81/53.1
5,507,209 A * 4/1996 Allen et al. ..... 81/124.2
7,181,995 B2 * 2/2007 Rider ..... 81/53.1
7,185,561 B1 * 3/2007 Eastman ..... 81/3.8

* cited by examiner

*Primary Examiner* — Debra S Meislin

(57) ABSTRACT

The Multi-Task-Tool provides more positive control of clamp-action-mounted power distribution devices while placing, tightening, loosening and removing the devices from their intended receivers, including but not limited to power lines and taps, and it may be attached to common extension sticks for long reach. Many electrical power distribution devices are secured in position directly or indirectly by a threaded fastener which is most often an eye bolt. The tool body receives and contains the eye bolt and a portion of the shank giving leverage to control the device. Once the distribution device is in place the tool is then rotated to position internal rails on each side of the eye and then pulled down to seat the eye against its aperture cap. Internal rails provide stops to transmit rotational force to the eye bolt in either direction. The tool may be modified to work with other fastener heads.

16 Claims, 6 Drawing Sheets

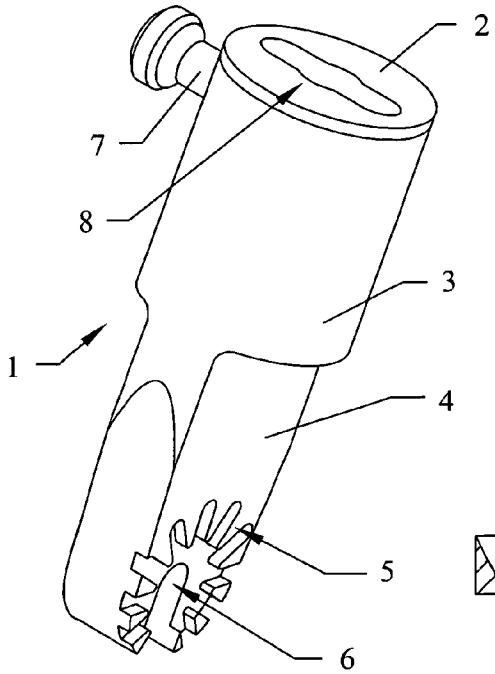
FIG 1
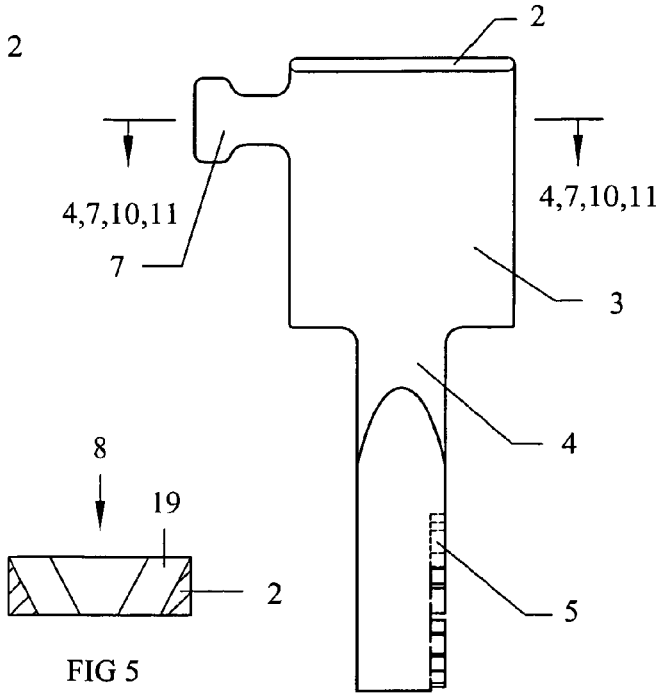
FIG 2
FIG 5
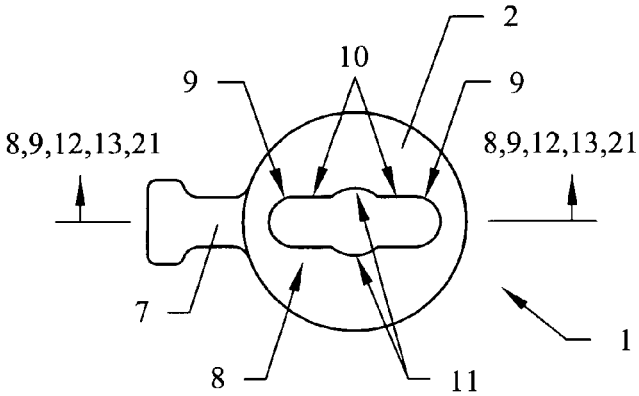
FIG 3
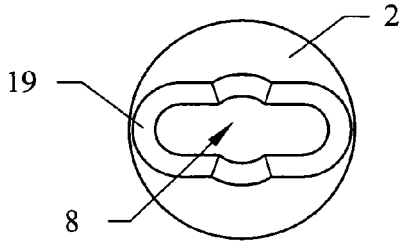
FIG 6
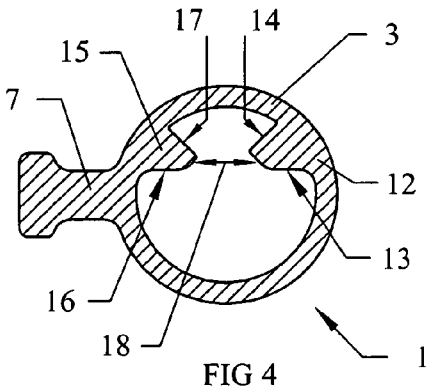
FIG 4
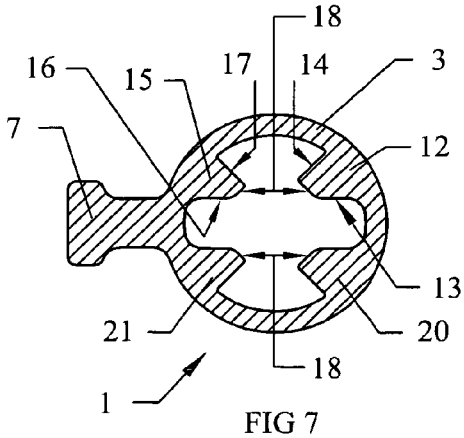
FIG 7

MULTI-TASK-TOOL

BACKGROUND OF THE INVENTION

1. Technical Field of the Invention

The invention is in the field of tools for manipulating threaded objects, such as eye bolts or winged nuts which provide clamping or operate clamps which position and secure power distribution devices.

2. Description of the Related Art

There is a continuing need to be able to install power distribution devices that are secured in position on their intended receiver including, but not limited to, power lines and taps, by clamping action created directly or indirectly by a threaded fastener. When an eye bolt is utilized the eye can serve as a lifting ring adaptive to a finger tool on an extension stick. However, this arrangement requires a lasso type motion to hook the device over its intended receiver and the off center position of common tool fingers may induce a wobbling motion further confounding the intended installation and even removals. A further need is to utilize an extension stick that is light weight and can be extended to sufficient length to accommodate installation and removal of elevated distribution devices from ground level which currently requires utilizing a boom truck.

SUMMARY OF THE INVENTION

According to an aspect of the invention, a tool attached to an extension stick for receiving the eye of an eye bolt or wing nut which operates a clamping action on a power distribution device.

According to another aspect of the invention, a tool attached to an extension stick for receiving the eye of an eye bolt or wing nut including an aperture cap and internal rails which operate a clamping action on a power distribution device.

According to another aspect of the invention, a tool attached to an extension stick including a full length rail inside the bore of the tool and shorter rails proximal to the aperture cap which accommodates allowing the eye or wing of a fastener to rotate approximately perpendicular to the entry and engage a portion of the aperture cap which prevents the fastener from exiting the tool and allows the user to exert pulling and/or simultaneous rotating force on the fastener.

According to another aspect of the invention, a tool attached to an extension stick for receiving the eye of and eye bolt or wing nut which operates a clamping action on a power distribution device. The extension stick is light weight and can be extended to reach such devices at heights, generally that of a common utility pole, that formerly required the user to be elevated in a boom truck.

According to another aspect of the invention, a tool attached to an extension stick for receiving the eye of an eye bolt or wing nut which operates a clamping action on a power distribution device further including a tool boss(es) on the body of the tool for receiving another tool either/both proximal or distal to the aperture cap.

According to another aspect of the invention, a tool attached to an extension stick for receiving the eye of an eye bolt or wing nut which operates a clamping action on a power distribution device further including a fixed, removable or retractable finger/hook mounted on the tool body.

According to another aspect of the invention, a tool attached to an extension stick for receiving the eye of an eye bolt or wing nut which operates a clamping action on a power distribution device further including a light source mounted in the tool base projecting light through the aperture cap.

According to yet another aspect of the invention, a tool attached to an extension sick for receiving the eye of an eye bolt or wing nut which operates a clamping action on a power distribution device further including a light source slideably mounted inside the bore of the tool upon a spring which urges it toward the aperture cap and will be pushed downward out of the way as the eye or wing enters the bore of the tool.

The Multi-Task-Tool provides more positive control of clamp-action-mounted power distribution devices while placing, tightening, loosening and removing the devices from their intended receivers, including but not limited to power lines and taps, and it may be attached to common extension sticks. The stick mounted Multi-Task-Tool receives and contains the eye and a portion of the shank of the eye bolt giving leverage to control the position of the device by the eye bolt. Once the distribution device is seated on its intended receiver the tool is then rotated to position internal rails on each side of the eye and then the tool is pulled down to seat the eye against its cap. In that position the internal rails provide stops to transmit rotational force to the eye of the eye bolt in either direction. The invention utilizes open tolerances to provide ease of attachment and removal of the tool. The widest portion of the eye bolt eye is referred to as its major diameter. Embodiments of the invention further provides bosses on the tool body for attachment of other tools, an embodiment with at retractable finger and embodiments which provide a light source.

BRIEF DESCRIPTION OF THE DRAWINGS

FIG. 1 is a perspective view of Multi-Task-Tool 1.

FIG. 2 is a side view of Multi-Task-Tool 1.

FIG. 3 is a top view of Multi-Task-Tool 1.

FIG. 4 is a cross section top view of body 3.

FIG. 5 Is a cross section side view of aperture cap 2 having eye bolt funnel 19.

FIG. 6 Is a top view of aperture cap 2 having eye bolt funnel 19.

FIG. 7 is a cross section top view of Multi-Task-Tool 1 with a second short rail 20 and third short rail 21.

DETAILED DESCRIPTION

Figure 8:
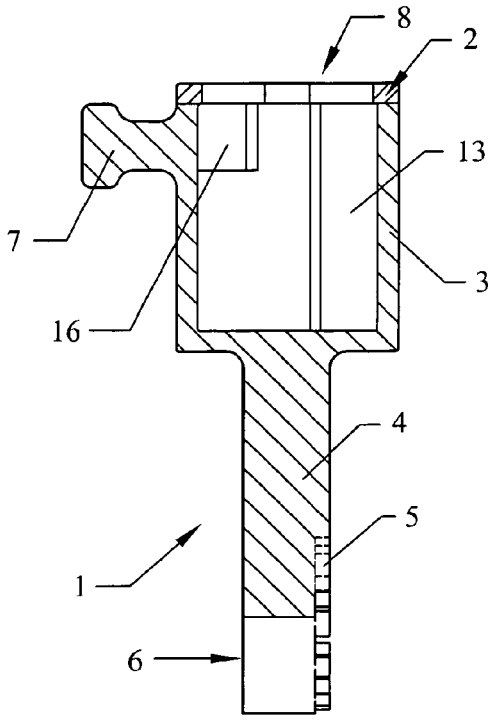
FIG. 8 is a cross section side view of Multi-Task-Tool 1.

FIGS. 1-4 and FIGS. 8-12 Show various views of the first embodiment of Multi-Task-Tool 1 consisting of an elongated cylindrical body 3 which defines a bore diameter that accommodates slide ably receiving the eye of an eye bolt or winged fastener. An aperture cap 2 defining a centrally located radius end 9 elongated aperture 8 with two parallel long edges 10 further defining central opposing shank radiuses 11 is attached across one end of the body. The device also includes a mounting base 4 attached or unitary to the body 3 at the opposite end from the aperture cap 2. The body 3 contains internally opposing long rail 12 and a short rail 15 within its bore having long rail first flat surface 13 and short rail first flat surface 16 together defining a plane having a first end aligned with and proximal to one long edge 10 of aperture cap 2. The rails central edges define rail slot 18 and respectively have long rail second flat surface 14 and short rail second flat surface 17 behind their first surfaces giving them a truncated triangle cross section. Long rail 12 extends the full internal length of the body. Opposing short rail 15 has a length that is about equal to one half the outermost diameter of the eye of eye bolt 22. The body 3 is of sufficient length to accommodate the eye being rotated inside the body below short rail 15. The first end of base 4 is attached to the body 3 opposite the aperture cap 2. The opposite end of the base 4 defines a mounting flange which is complementary to tool mounting flanges commonly found on extension sticks including, but not limited to, radial splines 5 and a tool mounting slot 6. An external secondary tool boss 7 is provided on body 3 proximal to the aperture cap 2 to accommodate mounting secondary tools. The secondary tool boss 7 may define internal or external threads or other complimentary attachment configuration or it may be a tool itself including but, not limited to, a finger.

Figure 22:
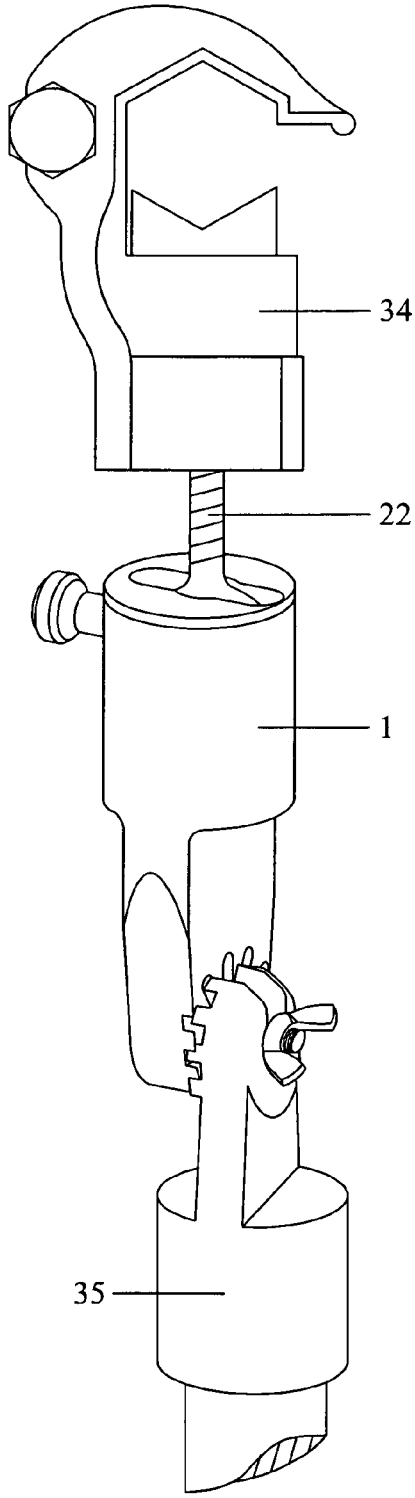
FIG. 22 is a perspective view of Multi-Task-Tool 1 mounted on extension stick 35 and with eye bolt 22 of a power distribution device 34 within Multi-Task-Tool 1.

Also referring to FIG. 22 showing Multi-Task-Tool 1 mounted to extension stick 35 and is used by passing the body 3 over the eye and a portion of the shank of the eye bolt 22 of a clamp-action-mounted power distribution device 34 by way of the elongated aperture 8. The first flat surfaces of the rails engage the major diameter of the eye and guide the eye bolt 22 through the body 3 toward the mounting base 4. After the eye is seated against the mounting base 4 the Multi-Task-Tool 1 may be rotated around the eye as one side of the eye passes under the short rail 15. The long rail second flat surface 14 engages a side of the eye and prevents the body 3 from spinning completely around the eye bolt 22. In that position with one side of eye bolt 22 against the long rail second flat surface, body 3 is then pulled back down the eye bolt 22 shank until the eye seats against the aperture cap 2. The eye becomes captured between the rails in the rail slot 18. The short rail 15 may also be beveled opposite aperture cap 2 to urge the eye into the rail slot 18. The body 3 will now be able to transmit rotational force on the eye bolt 22 in either direction while maintaining control of the position of the clamp-action-mounted power distribution device 34 by contact in body 3 and elongated aperture 8.

Now referring to FIGS. 5-7 and showing alternate embodiments, aperture cap 2 may be of sufficient thickness to define a bevel around the elongated aperture to provide an eye funnel 19 to help guide the eye bolt 22 through elongated aperture 8. Second short rail 20 and third short rail 21 cross sections and positions mirror image each other and as a pair mirror image long rail 12 and short rail 15 as a pair. They engage the opposite side of eye bolt 22's eye the same as long rail 12 and short rail 15 engage the first side when body 3 is pulled down eye bolt 22's shank.

FIG. 8 is a cross section (FIG. 3) of Multi-Task-Tool 1 showing aperture cap 2, elongated aperture 8, body 3, base 4 with tool mount flange splines 5, tool mounting slot 6 and secondary tool boss 7 also showing first rail long rail first surface 13 and short rail first surface 16.

Figure 9:
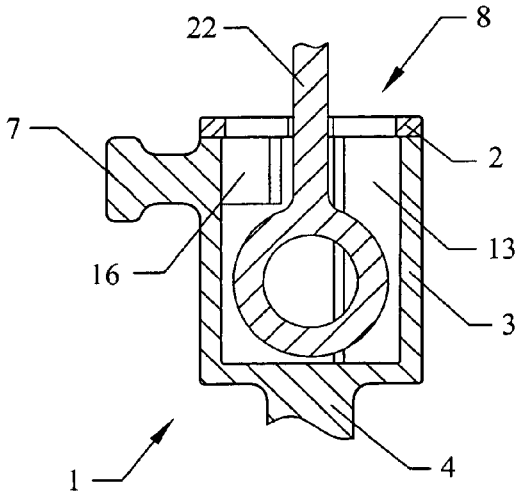
FIG. 9 is a partial cross section side view of Multi-Task-Tool 1 with eye bolt 22 seated on base 4.

FIG. 9 is a partial cross section view (FIG. 3) of Multi-Task-Tool 1 showing aperture cap 2, body 3, base 4, secondary tool boss 7, elongated aperture 8, also showing long first surface 13 and short rail first surface 16 with eye bolt 22 resting on base 4.

Figure 10:
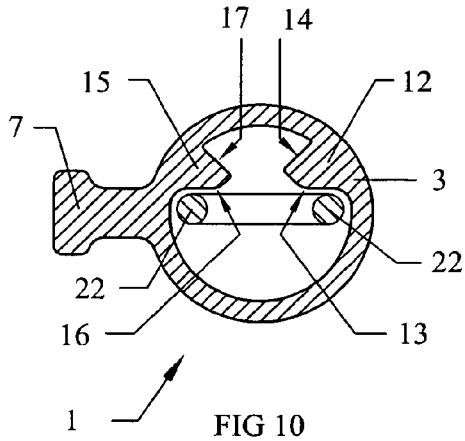
FIG. 10 is a cross section top view of Multi-Task-Tool 1 with eye bolt 22.

FIG. 10 is a cross section top view (FIG. 2) of Multi-Task-Tool 1 showing body 3, secondary tool boss 7, long rail 12 with long rail first surface 13, long rail second surface 14, short rail 15, short rail first surface 16 and short rail second surface 17. Also shown is eye bolt 22 in the position shown in FIG. 6 against long rail first surface 13. Eye bolt 22 is below sort rail 15 in that position and therefore not touching first short rail 16.

Figure 11:
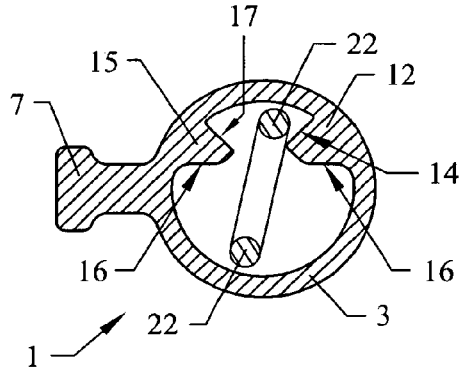
FIG. 11 is a cross section top view of Multi-Task-Tool 1 with eye bolt 22.

FIG. 11 is a cross section top view (FIG. 2) of Multi-Task-Tool 1 showing body 3, secondary tool boss 7, long rail 12 with long rail first surface 13, long rail second surface 14, short rail 15, short rail first surface 16 and short rail second surface 17. Also shown is eye bolt 22 against aperture cap 2 (in the position shown in FIG. 10) against long rail second surface 14.

Figure 12:
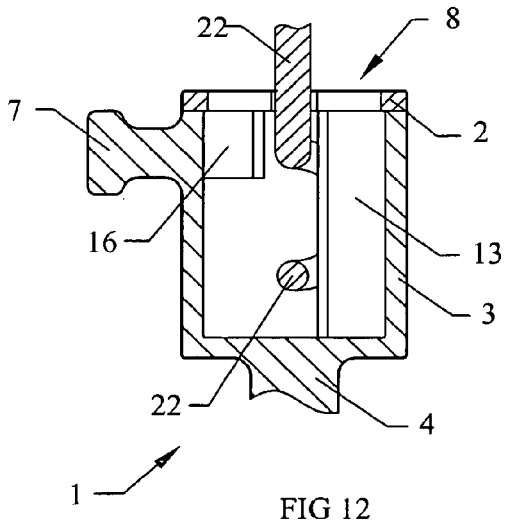
FIG. 12 is a partial cross section side view of Multi-Task-Tool 1 with eye bolt 22 against aperture cap 2.
Figure 13:
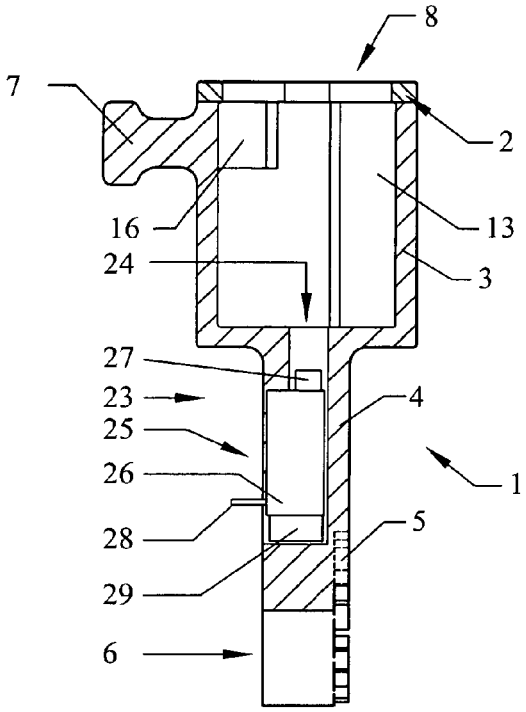
FIG. 13 is a cross section side view of Multi-Task-Tool 1 with light pocket 23 and light source 25.
Figure 14:
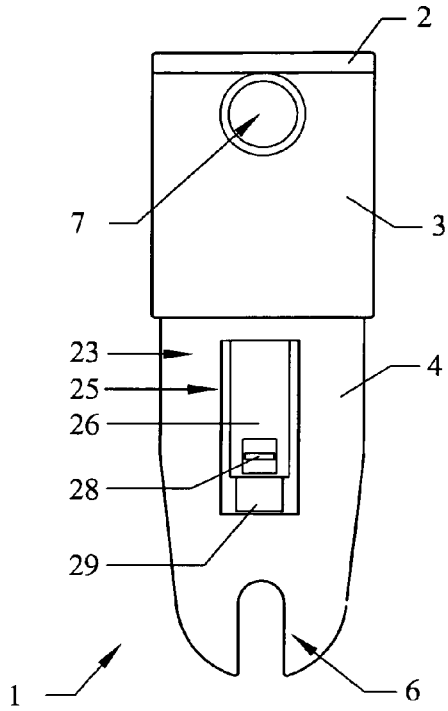
FIG. 14 is a side view of Multi-Task-Tool 1 with light pocket 23 and light source 25.
Figure 15:
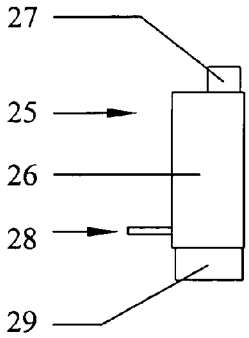
FIG. 15 is a side view of light source 25.
Figure 16:
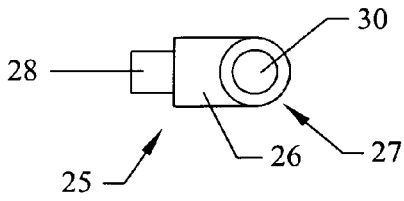
FIG. 16 is a top view of light source 25.
Figure 17:
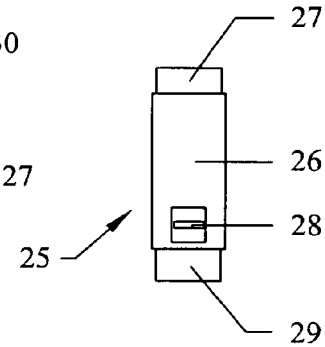
FIG. 17 is a front view of light source 25.
Figure 18:
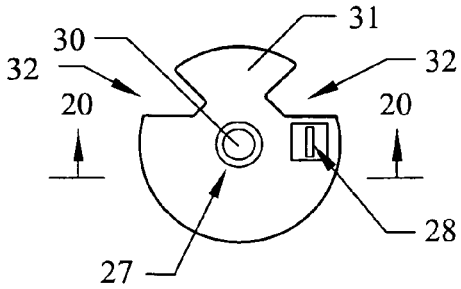
FIG. 18 is a top view of light source piston 31.
Figure 19:
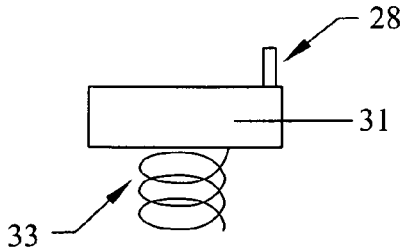
FIG. 19 is a side view of light source piston 31.
Figure 20:
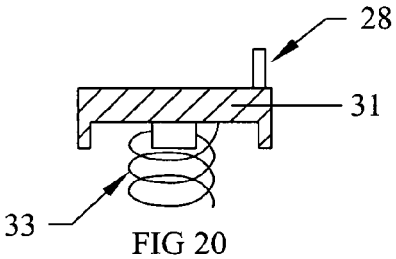
FIG. 20 is a cross section side view of light source piston 31.
Figure 21:
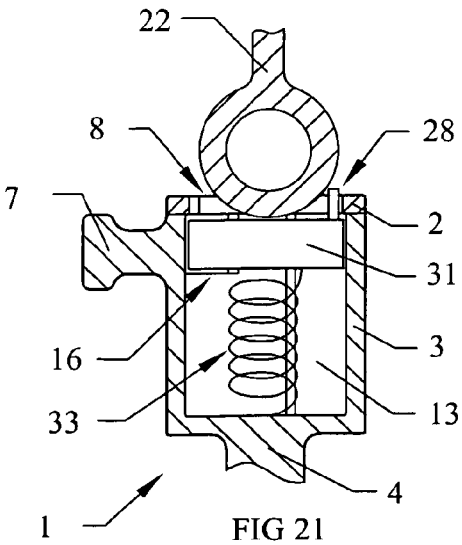
FIG. 21 is a partial cross section side view of Multi-Task-Tool 1 with light source piston 31 and eye bolt 22.

FIG. 12 is a partial cross section front view (FIG. 3) of Multi-Task-Tool 1 showing aperture cap 2, body 3, base 4, secondary tool boss 7, elongated aperture 8, also showing long rail first surface 13 and short rail first surface 16 with eye bolt 22 against aperture cap 2 and long rail second surface 14 (not shown).

Referring to FIGS. 13-17, often the need for electrical power 24/7 mandates that maintenance is preformed in low light or total darkness. To help facilitate working in the dark, a light source 25 which has a housing 26 which contains a power source, lens holder 27, lens 30, switch 28 and spring base 29 is mounted in light pocket 23 provided in the base 4 which shines through a light aperture 24 through body 3 and out the elongated aperture 8. The light source 25 may be integral or removable. If removable the spring base 29 urges the housing against the opposite end of the light pocket 23 to hold it in place.

Referring to FIGS. 18-21 yet another embodiment provides a light source piston 31 which can float in the bore of the body 3 with a spring 33 underneath the piston 31 acting on the base 4 to urge the piston 31 toward the aperture cap 2. Light source piston 31 also has rail cutouts 32 to conform to the bore of body 3. The spring pressure is easily overcome by the weight of an electrical power distribution device 34. The focused light gives general illumination and tends to serve as aiming device. As a fastener enters the body 3 through the aperture cap 2 the piston 31 is pushed downward and out of the way. The length of the body 3 for this embodiment is extended to provide room for light source piston 31 in its compressed position against the base 4 while retaining all other features. The switch 28 would extend into and be accessed through elongated aperture 8 while the piston 31 is at rest against aperture cap 2. The switch 28 would be off-sided in the elongated aperture 8 which places it outside the sweep of the eye bolt 22 eye's major diameter. In this embodiment the aperture cap 2 is removable for access to the light source piston 31.

Figure 23:
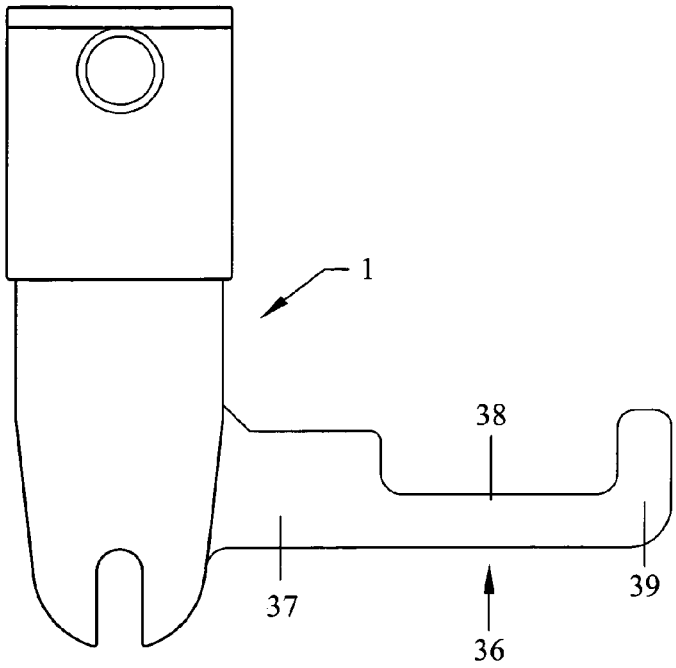
FIG. 23 is a front view of Multi-Task-Tool 1 with fixed finger/hook 36 attached.

Referring to FIG. 23 often other power distribution devices must be lifted or removed from elevated positions especially those energized by hot lines using hot line clamps including, but not limited to; fuse barrels. The above embodiments of Multi-Task-Tool 1 are useful to attach and remove hot lines and open and close fuse barrel holders and with skillful use of the fixed tool boss 7 a lineman can lift a fuse barrel. However, a more convenient fixed, removable or foldable finger/hook is added. Fixed finger/hook 36 has a stand-out section 37 which is affixed or unitary to base 4. Midsection 38 has a reduced height compared to the stand-out section 37 and distal end 39 is at least equal height to stand-out section 36 together forming an elongated hook.

Referring to FIGS. 24-27 another embodiment of the finger/hook with a removable finger/hook is provided. An alternate tool boss 42 is formed into base 4 generally, a threaded aperture with a surrounding counter sink. Removable finger/hook 40 has a threaded end 41 proximal to stand-off section 37, a reduced height midsection 38 and distal end 39 which together form an elongated hook.

Figure 24:
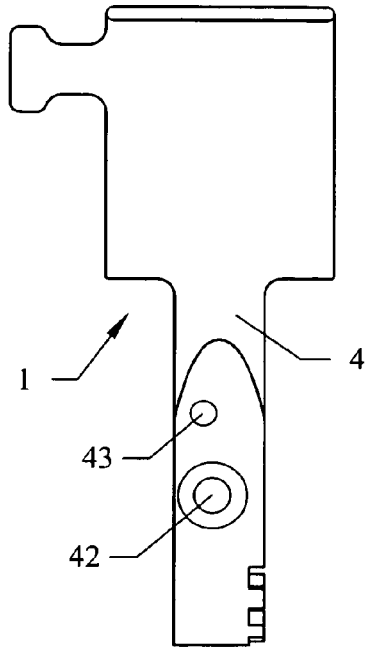
FIG. 24 is a side view of Multi-Task-Tool 1 with alternate tool boss 42 and stop-pin aperture 43.
Figure 25:
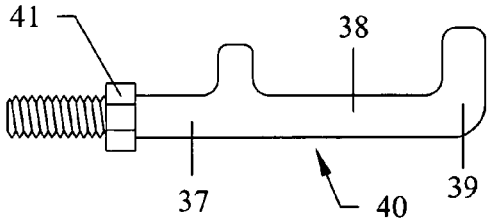
FIG. 25 is a front view of removable finger/hook 40.
Figure 26:
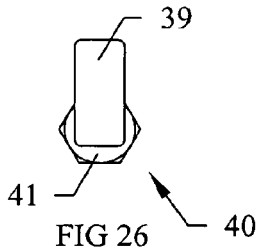
FIG. 26 is an end view of removable finger/hook 40.
Figure 27:
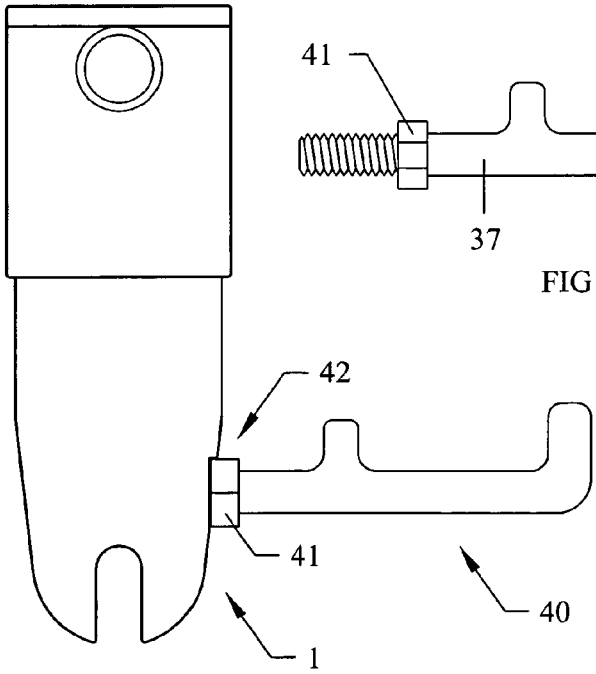
FIG. 27 is a front view of Multi-Task-Tool 1 with removable finger/hook 40 attached.
Figure 28:
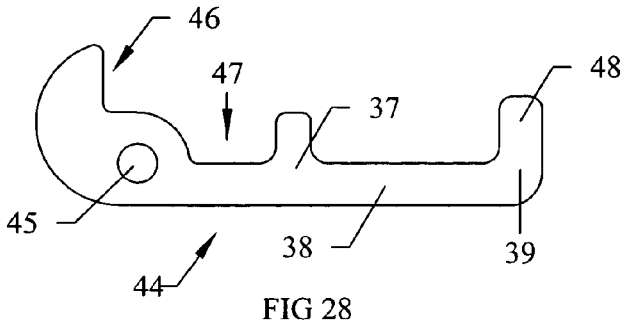
FIG. 28 is a front view of movable finger/hook 44.
Figure 29:
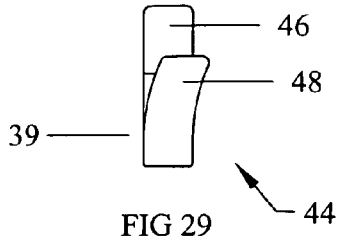
FIG. 29 is an end view of movable finger/hook 44.
Figure 30:
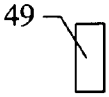
FIG. 30 is a side view of spacer washer 49.
Figure 31:
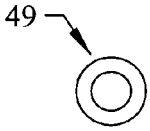
FIG. 31 is a front view of spacer washer 49.
Figure 32:
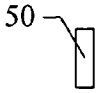
FIG. 32 is a side view of elastic washer 50.
Figure 33:
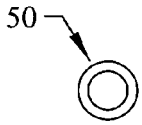
FIG. 33 is a front view of elastic washer 50.
Figure 34:
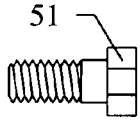
FIG. 34 is a side view of mounting bolt 51.
Figure 35:
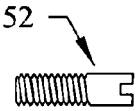
FIG. 35 is a side view of stop-pin 52.
Figure 36:
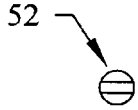
FIG. 36 is an end view of stop-pin 52.
Figure 38:
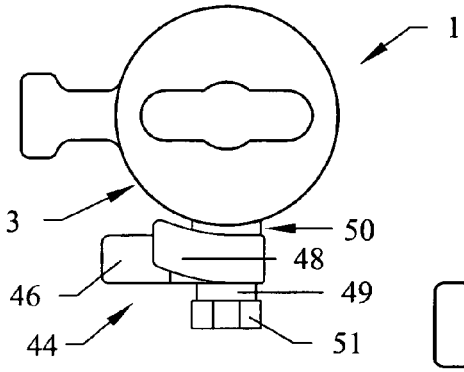
FIG. 38 is a top view of Multi-Task-Tool 1 with movable finger/hook 44 in its folded position.
Figure 37:
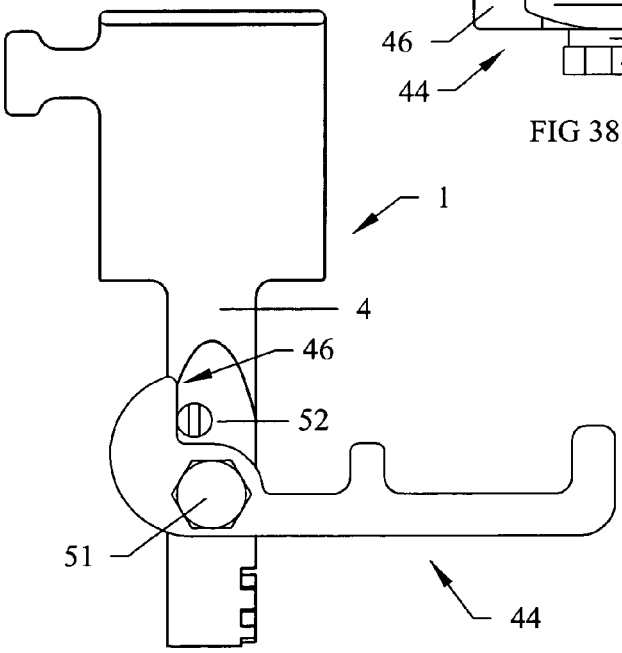
FIG. 37 is a side view of Multi-Task-Tool 1 with movable finger/hook 44 in its lifting position.
Figure 39:
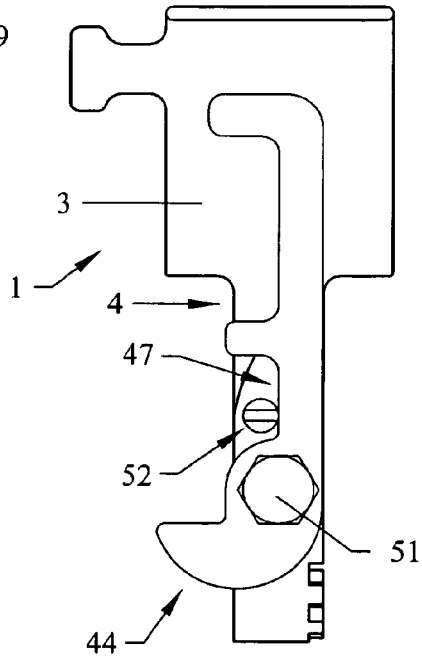
FIG. 39 is a side view of Multi-Task-Tool 1 with movable finger/hook 44 in its folded position.

Referring to FIGS. 28-39 another embodiment of the finger/hook with a folding finger/hook is provided. In FIG. 24 base 4 has stop-pin aperture 43 proximal to alternate tool boss 42. Folding finger/hook 44 stand-off end 37 defines mounting aperture 45, lifting stop surface 46 and folding stop surface 47. Midsection 38 has a reduced height and distal end 39 is at least the height of stand-off end 37 together forming an elongated hook. Distal end 39 is further formed perpendicular to the finger's length to form snap-tip 48. Folding finger/hook 44 is mounted to the Multi-Task-Tool 1 by way of mounting bolt 51 passed through elastic washer 50, the finger and spacer washer 49 and threaded into alternate tool boss 42 on base 4. Stop-pin 52 is threaded into stop-pin aperture 43. Elastic washer 50 acts on mounting bolt 51 and the finger and tends to resist movement of the finger. As folding finger/hook 44 is rotated into its extended lifting position, lifting stop surface 46 engages stop-pin 52. As folding finger/hook 44 is rotated into its retracted position, snap-tip 48 engages the side of body 3 and elastic washer 50 allows the finger to flex as the snap-tip latches over body 3 and folding stop 47 engages stop-pin 52.

The embodiments disclosed in the description and drawings are intended to illuminate rather than limit the equivalent devices that may be envisioned by those skilled in the art.

The invention claimed is:

1. A linemen's Multi-Task-Tool system for manipulation, installation and removal of clamp-action-mounted power distribution devices comprising:

an extension stick adaptive to mounted tools;

an eye bolt, having a shank, actuated clamp-action-mounted power distribution device;

an extension stick remove-ably mounted socket comprising:

an elongated cylindrical body having a first end, a length of at least one and a half times the major diameter of the eye of said eye bolt and a second end and an external secondary tool boss adaptive to receive secondary tools proximal to said first end;

said body having an internal bore defining a long and short longitudinal rail each having a first end, a length and a second end and a generally truncated triangle cross section;

an aperture cap adaptive to being attached across said body's first end defining a centrally located radius end elongated aperture having opposing long edges and further defining central opposing shank radiuses adaptive to passing over said eye bolt eye and a portion of its shank;

said rails being offset from the center of said internal bore having first flat surfaces that define a longitudinal plane that runs substantially perpendicular to and said first ends proximal to a long edge of said elongated aperture and further defining a rail slot between said rails having a width of at least greater than the thickness of said eye bolt eye and each having a second flat surface behind said plane;

said long rail extending the internal length of said body and said short rail length being approximately equal to one half the outside diameter of the eye of said eye bolt;

a base having a first end a length and a second end;

said base's first end being adaptive to attachment to said body's second end and said base's second end being adaptive to and being mounted on said extension stick; and said eye bolt of said distribution device seated into said body of said Multi-Task-Tool.

2. The system of claim 1 wherein said body and base are unitary.

3. The system of claim 1 wherein said secondary tool attach boss constitutes:

a shaft having a first end, a length and a second end;

said first end being affixed or unitary to said body proximal to said first end;

said length of a predetermined diameter protruding a predetermined length from said body; and said second end having a larger diameter than said length.

4. The system of claim 1 wherein said short rail further comprises:

said second end beveled to urge said eye into the rail slot between the long and short rail.

5. The system of claim 1 further comprising said secondary tool boss being a tool connector;

a secondary tool have a connection end complementary to said tool boss connector;

and said secondary tool secured to said secondary tool boss.

6. The system of claim 1 wherein said aperture cap comprises;

a predetermined thickness with a reduced region defining a beveled funnel edge around the perimeter of said elongated aperture which urges said eyebolt eye into said elongated aperture.

7. The system of claim 1 wherein said base further defines a light pocket adaptive to receive a light source and also defining and in communication with a centrally located light aperture from said light pocket into said body and further having a light source;

said light source comprising;

a housing which contains a power source;

a lens;

a lens holder attached to said housing adaptive to receive said lens;

a power switch;

a spring base attached to said housing opposite said lens holder adaptive to urge said housing against an opposite end of said light pocket; and said light source mounted within said light pocket.

8. The system of claim 1 wherein said system further comprises;

a light source piston;

a light source;

a spring;

said body's length extended by at least the height of said piston; and said aperture cap remove-ably attached to said socket said piston being adaptive to slide ably engaged the bore of said body including defining edge cutouts companionate to said rails of said socket having an upper surface and skirt and defining a housing beneath said upper surface which contains a power source;

said light source centrally located on said upper surface;

a lens;

a lens holder;

a switch which is mounded on said piston and extends through said elongated aperture at one end;

said light source's beam being substantially perpendicular to said upper surface;

said piston mounted within said bore with said upper surface proximal to said aperture cap; and said spring mounted within said piston skirt opposite said light source acting on said base urging said piston toward said aperture cap.

9. The system of claim 1 wherein said body's internal bore further defines a second and third short longitudinal rail each having a first end, a length and a second end and a generally truncated triangle cross section;

said second and third short rails generally being a mirror image of said long and short rail together and being approximately the same length and height position of said short rail in said cylinder bore.

10. The system of claim 1 wherein said base further comprises;

an alternate tool boss proximal to said base's second end adaptive to receive alternate tools.

11. The system of claim 1 wherein an alternate tool boss comprises an affixed or unitary fixed finger/hook;

said fixed finger/hook having a stand-offend, a mid section and a distal end;

said stand-off end having a thickness, height and a length;

said mid section having a thickness, a length and a reduced height;

said distal end having a thickness, a length and height approximate to said stand-off end height together with said midsection and said stand-off end forming an elongated hook; and said stand-off end attached to said base.

12. The system of claim 1 wherein said base further comprises;

an alternate tool boss proximal to said base's second comprising an internally threaded aperture surrounded by a perpendicular counter sunk area;

a removable finger/hook said removable finger/hook comprising;

a stand off end having thickness, height and length and its proximal end having external threads companionate to the internal threads of said tool boss;

a mid section having thickness, length and reduced height;

a distal section having thickness, length and height approximate to said stand-off end height together with said mid section and said stand-off end forming an elongated hook; and said removable finger/hook attached to said base by said external threads engaged in said internal threads.

13. The system of claim 1 wherein said base further comprises;

an alternate tool boss proximal to said base's second comprising an internally threaded aperture surrounded by a perpendicular counter sunk area;

said base further comprising a stop-pin internally threaded aperture proximal to said alternate tool boss;

a round stop-pin having a length, a threaded end and an opposite slotted end;

a mounting bolt;

a spacer washer;

an elastic washer;

a folding finger/hook;

said stop-pin mounted in said stop-pin aperture;

said finger hook comprising a stand-off end, mid section and a distal section each having a thickness, a length and a height;

said stand-off end defining a mounting aperture and comprising;

a semi-circular end, said folding finger mounted to said alternate tool boss by passing said bolt through said elastic washer, said finger and said spacer washer and engaging said bolt's threads into said threaded alternate tool boss;

said stand-off end further defining a lifting stop surface perpendicular to said finger's length proximal to said mounting aperture when engaged on said stop-pin holds the finger at a substantially 90 degree angle to the length of said body;

a folding stop surface being a reduced height area substantially 90 degrees to said lifting stop surface substantially parallel to said finger when engaged on said stop-pin holds said finger substantially parallel to said body's length, said mid section having a reduced height together with the distal end of said stand-off section and said distal end forming an elongated hook;

the tip of said distal end being formed into a snap-tip having a curve companionate to the outer radius of said body and perpendicular to the length of said finger;

said elastic washer allows said finger to flex as said snap-tip passes over said body as said finger is moved into its folded position; and said elastic washer acts on said finger and said bolt to resist radial movement of said finger.

14. A linemen's Multi-Task-Tool system for manipulation, installation and removal of clamp-action-mounted power distribution devices comprising:

an extension stick adaptive to mounted tools;

an eye bolt actuated clamp-action-mounted power distribution device;

an extension stick remove-ably mounted socket comprising:

an elongated cylindrical body having a first end, a length of at least one and a half times the major diameter of the eye of said eye bolt and a second end;

an external secondary tool boss proximal to said body's first end constituting;

a shaft having a first end, a length and a second end;

said first end affixed or unitary to said body;

said length of a predetermined diameter protruding a predetermined length from said body; and said second end opposite said body having a larger diameter than said length;

said body having an internal bore defining a long and short longitudinal rail each having a first end, a length and a second end and a generally truncated triangle cross section;

an aperture cap adaptive to being attached across said body's first end defining a centrally located radius end elongated aperture having opposing long edges and further defining central opposing shank radiuses adaptive to passing over said eye bolt's eye and a portion of its shank;

said aperture cap's having a predetermined thickness and reduced region defining a beveled funnel edge around the perimeter of said elongated aperture which urges said eyebolt eye into said elongated aperture;

said rails being offset from the center of said internal bore having first flat surfaces that define a longitudinal plane that runs substantially perpendicular to and said first ends proximal to a long edge of said cap aperture and further defining a rail slot between said rails having a width of at least greater than the thickness of said eye bolt eye and each having a second flat surface behind said plane;

said long rail extending the internal length of said body and said short rail length being approximately equal to one half the outside diameter of the eye of said eye bolt;

said body's internal bore further defining a second and third short longitudinal rail each having a first end, a length and a second end and a generally truncated triangle cross section;

said second and third short rails generally being a mirror image of said long and short rail together and being approximately the same length and height position of said short rail opposite and in said cylinder bore;

said short rails second ends being beveled to urge said eyebolt into said rail slot;

a base having a first end a length and a second end;

said base's first end attached to said body's second end and said base's second end being adaptive to and being mounted on said extension stick;

said base further comprising:

an alternate tool boss proximal to said base's second comprising an internally threaded aperture surrounded by a perpendicular counter sunk area;

said base further comprising an internally threaded stop-pin aperture proximal to said alternate tool boss;

a round stop-pin having a length, a threaded end and an opposite slotted end;

a mounting bolt;

a spacer washer;

an elastic washer;

a folding finger/hook;

said stop-pin mounted in said stop-pin aperture;

said finger hook comprising a stand-off end, mid section and a distal section each having a thickness, a length and a height;

said stand-off end defining a mounting aperture and comprising;

a semi-circular end, said folding finger mounted to said alternate tool boss by passing said bolt through said elastic washer, said finger and said spacer washer and engaging said bolt's threads into said threaded alternate tool boss;

said stand-off end further defining a lifting stop surface perpendicular to said finger's length proximal to said mounting aperture and when engaged on said stop-pin holds the finger at a substantially 90 degree angle to the length of said body;

a folding stop surface defining a reduced height area substantially 90 degrees to said lifting stop surface substantially parallel to said finger when engaged on said stop-pin holds said finger substantially parallel to said socket's length, said mid section having a reduced height together with the distal end of said stand-off section and said distal end forming an elongated hook;

the tip of said distal end being formed into a snap-tip having a curve companionate to the outer radius of said body and perpendicular to the length of said finger;

said elastic washer allows said finger to flex as said snap-tip passes over said body as said finger is moved into its folded position;

said elastic washer acts on said finger and said bolt to resist radial movement of said finger; and said eye bolt of said distribution device seated into said body.

15. The system of claim 14 wherein said base further defines a light pocket adaptive to receive a light source and also defining and in communication with a centrally located light aperture from said light pocket into said body and further having a light source;

said light source comprising;

a housing which contains a power source;

a lens;

a lens holder attached to said housing adaptive to receive said lens;

a power switch;

a spring base attached to said housing opposite said lens holder adaptive to urge said housing against an opposite end of said light pocket; and said light source mounted within said light pocket.

16. The system of claim 14 wherein said system further comprises;

a light piston;

a light source;

a spring;

said socket's length extended by at least the height of said piston; and said aperture cap remove-ably attached to said socket said piston being adaptive to slide ably engaged the bore including defining edge cutouts companionate to said rails of said body having an upper surface and skirt and defining a housing beneath said upper surface which contains a power source;

said light source centrally located on said upper surface;

a lens;

a lens holder;

a switch which is mounded on said piston and extends through said elongated aperture at one end;

said light source's beam being substantially perpendicular to said upper surface;

said piston mounted within said bore with said upper surface proximal to said aperture cap; and said spring mounted within said piston skirt opposite said light source acting on said base urging said piston toward said aperture cap.

* * * * *